US005713335A

United States Patent [19]

Perr et al.

[11] Patent Number: 5,713,335

[45] Date of Patent: Feb. 3, 1998

[54] VARIABLE INJECTION TIMING AND INJECTION PRESSURE CONTROL ARRANGEMENT

[75] Inventors: Julius P. Perr; Lester L. Peters; Amarjit S. Ghuman; Benjamin M. Yen, all of Columbus; Edward D. Smith, W. Greensburg; David L. Buchanan, Westport; Yul J. Tarr, Columbus; Laszlo D. Tikk, Columbus; Andrew G. Stiles, Columbus, all of Ind.

[73] Assignee: Cummins Engine Company, Inc., Columbus, Ind.

[21] Appl. No.: 659,619

[22] Filed: Jun. 6, 1996

Related U.S. Application Data

[63] Continuation-in-part of Ser. No. 527,346, Sep. 12, 1995, abandoned.

[51] Int. Cl.[6] ..... F02M 37/04

[52] U.S. Cl. ..... 123/501; 123/508; 123/496

[58] Field of Search ..... 123/501, 507, 123/500, 508, 496

[56] References Cited

U.S. PATENT DOCUMENTS

| | | | |
|---|---|---|---|
| Re. 30,189 | 1/1980 | Perr | 123/496 |
| 1,865,099 | 6/1932 | Groff | 123/496 |
| 3,815,564 | 6/1974 | Suda et al. . | |
| 3,859,973 | 1/1975 | Dreisin . | |
| 4,206,734 | 6/1980 | Perr et al. . | |
| 4,235,374 | 11/1980 | Walter et al. . | |
| 4,306,528 | 12/1981 | Straubel et al. . | |
| 4,308,839 | 1/1982 | Hafner et al. . | |
| 4,471,909 | 9/1984 | Perr . | |
| 4,530,336 | 7/1985 | Ichinose . | |
| 4,531,672 | 7/1985 | Smith . | |
| 4,617,903 | 10/1986 | Heberle et al. . | |
| 4,649,889 | 3/1987 | Igashira | 123/508 |
| 4,721,247 | 1/1988 | Perr . | |
| 4,986,472 | 1/1991 | Warlick et al. . | |

FOREIGN PATENT DOCUMENTS

| | | | |
|---|---|---|---|
| 467443 | 10/1928 | Germany | 123/501 |
| 3417591 | 11/1984 | Germany | 123/501 |
| 286967 | 6/1931 | Italy | 123/501 |
| 56-92329 | 7/1981 | Japan . | |
| 0039964 | 3/1984 | Japan | 123/501 |
| 59-185828 | 10/1984 | Japan . | |
| 32490 | 4/1934 | Netherlands | 123/500 |
| 2034810 | 6/1980 | United Kingdom | 123/501 |

*Primary Examiner*—Carl S. Miller

*Attorney, Agent, or Firm*—Sixbey, Friedman, Leedom & Ferguson, P.C.; Charles M. Leedom; David S. Safran

[57] ABSTRACT

In accordance with preferred embodiments of the invention a timing adjustment device includes a cam follower that is engaged between an overhead cam and an injector rocker arm, and is mounted on a rotatable eccentric shaft. The geometry of the eccentric shaft and cam follower is designed so that, as timing is varied by rotation of the eccentric shaft, no change is produced in the vertical height of the rocker arm when the cam shaft is on the outer base circle and the injector is bottomed, in order to assure that the "mechanical crush" of the PT type injector is constant despite changes in timing. In a first application of the timing arrangement, it is used together with a simple injector, which does not utilize a multi-plunger arrangement to form a hydraulic link, to achieve lower parasitic losses. To obtain independent control over injection pressure and timing, a fuel injector in which a hydraulic link is formed between plungers of a multi-plunger arrangement is used with the timing arrangement in order to allow the injection pressure to be maintained constant over a wide range of engine speeds without interfering with engine timing.

18 Claims, 9 Drawing Sheets

27
DRAIN
26
$P_{OIL}$
21
23
25
27a
10
10a
10b
19
15
16a
16
18
32
ECM
ENCODER
30
27a
25
23
$P_{OIL}$
21
26
27
DRAIN

FIG. 13
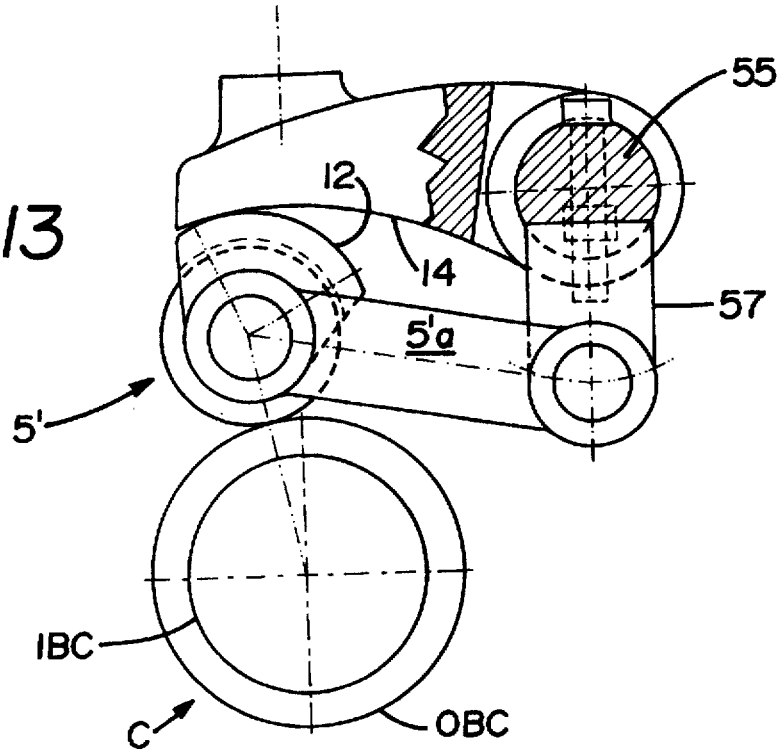
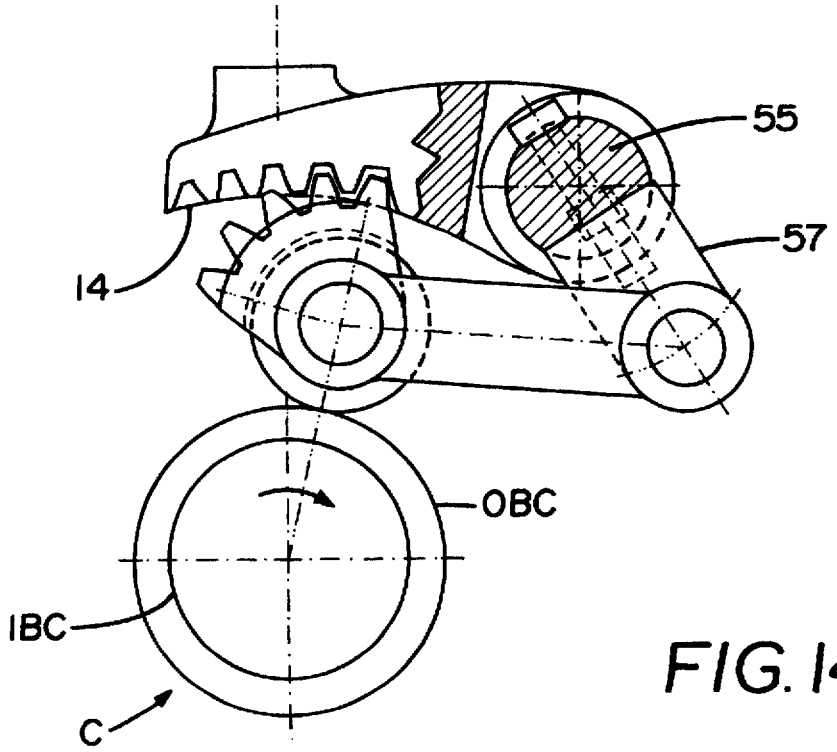
FIG. 14

VARIABLE INJECTION TIMING AND INJECTION PRESSURE CONTROL ARRANGEMENT

This application is a Continuation-in-Part of Ser. No. 08/527,346, filed Sep. 12, 1995, now abandoned.

BACKGROUND OF THE INVENTION

1. Field of the Invention

The present invention relates to unit fuel injectors and in particular to arrangements by which the timing at which injection is commenced is controlled.

2. Description of Related Art

Unit fuel injectors which include a multi-plunger injector having a timing chamber into which a variable quantity of timing fluid is supplied on a pressure-time basis (PT) to form a hydraulic link between the plungers, the length of which is varied to change the injection timing, are well known. Two of the most prevalent types are the HPI and the CELECT type unit injectors of the assignee of the present application. Representative examples of HPI injectors are the high pressure unit fuel injectors disclosed in Warlick et al. U.S. Pat. No. 4,986,472 and Perr U.S. Pat. No. 4,721,247, among others. Examples of CELECT type unit fuel injectors can be found, for instance, in Smith U.S. Pat. No. 4,531,672 and Walter et al. U.S. Pat. No. 4,235,374.

Unit fuel injectors of the noted types have proven themselves to be reliable and effective, and have played a significant role in the achievement of fuel injection systems for internal combustion engines which obtain improved engine emissions without sacrificing fuel economy and power. Nonetheless, the use of a hydraulic link is not without its disadvantages. The hydraulic links found in these prior art fuel injectors are subject to parasitic losses and high pressure leakage. The parasitic losses are reflected in the high temperature of the fuel (which also serves as the timing fluid) which is spilled when the timing chamber is emptied each cycle and which otherwise leaks back to the fuel supply system. The high temperature of the spill and leakage fuel is a prime reason why all known high pressure fuel systems currently require fuel coolers.

Additionally, HPI and CELECT type injectors have a variable overtravel and an inherent effect of varying the timing by changing the length of a hydraulic link is that the injection event occurs at a different point on the cam shaft when, e.g., the timing is retarded than when it is advanced. This has the effect of causing the injection event to occur at a higher camshaft velocity with an advanced engine timing than at a retarded engine timing, which results in a change in the injection pressure being associated with such a timing change. To meet future emissions and performance requirements; it now appears that it will be necessary to be able to control injection pressure independently of injection timing, thereby enabling, for example, the injection pressure to be maintained constant despite a change in timing.

A fuel injection system which does not utilize a hydraulic link for timing purposes is described in Perr et al. U.S. Pat. No. 4,206,734. The adjustable timing mechanism for a fuel injection system of this patent utilizes a shaft having an eccentric portion which rotates to move a cam follower with respect to a cam to vary the timing of injection of a fuel injector. The mechanism is designed to ensure that the rocker arm and injector plunger remain in essentially the same position at the end of the injection stroke regardless of the setting of the timing, thus allowing the timing to be adjusted during operation of the injector while ensuring a substantially constant mechanical load on the injector. However, timing adjustment using the device disclosed in this Perr et al. patent does cause small changes in the position of the rocker arm and injector plunger, and thus, changes, to some degree, the mechanical load or "crush" on the injector body. Also, the Perr et al. device is not designed for use with an overhead cam and requires the use of a push rod or link positioned between the cam follower and the rocker arm. Furthermore, its actuating arrangement for controlling the rotation of the eccentric shaft, which is designed to mount to the side of the engine, requires arm and linkage arrangements imposing undesirably large space requirements.

U.S. Pat. No. 4,306,528 to Straubel et al. discloses an injection pressure and timing control device that includes a timing setting device that is connected to a multi-plunger unit injector for controlling the onset of injection, and an injector drive and timing correction apparatus connected to an injector rocker arm for correcting, or compensating for, excessive or undesired variations in the timing of injection caused by the timing setting device, thus allowing the injection pressure to be controlled independently of the engine speed. In particular, the timing setting device controls the amount of fluid in a timing chamber to form a variable length hydraulic link, and the injector drive and timing correction apparatus may include an actuator arm that pivots a rotatable eccentric shaft for advancing or retarding the injection timing by shifting a drive lever which forms a cam follower disposed between the timing cam and a connecting link acting on the rocker arm. However, this arrangement is not intended for an injector which operates on pressure-time (PT) metering principles for metering of fuel into the timing chamber (as does the HPI type injector) and cannot assure that the rocker arm remains in essentially the same position at the end of the injection stroke regardless of the timing setting.

SUMMARY OF THE INVENTION

In view of the foregoing it is an object of the present invention to provide a control arrangement for unit fuel injectors which permits adjustment of injection timing in a manner maintaining constant mechanical crush.

It is another object of the present invention to obtain an arrangement for unit fuel injectors that is able to control injection pressure independently of injection timing.

It is a further object of the present invention to obtain the foregoing objects in a manner which can be applied to engines having an overhead cam drive train using a cam follower between a cam and rocker arm.

It is an additional object of the present invention to obtain the foregoing objects in a manner which can be applied to unit fuel injectors which meter fuel on a pressure-time basis.

Still another object of the present invention is to achieve a timing adjustment device including a cam follower for engaging a rocker arm via an eccentric connection device that does not impose undesirably large space requirements.

These and other objects are achieved by preferred embodiments of the invention in which the timing adjustment device includes a cam follower that is engaged between an overhead cam and an injector rocker arm, and is mounted on a rotatable eccentric shaft. The geometry of the eccentric shaft and cam follower is designed so that, as timing is varied by rotation of the eccentric shaft, no change is produced in the vertical height of the rocker arm when the cam shaft is on the outer base circle and the injector is bottomed, in order to assure that the "mechanical crush" of the PT type injector is constant despite changes in timing.

In a first application of the timing arrangement, it is applied to a simple injector which does not utilize a multi-plunger arrangement to form a hydraulic link. Such an injection system achieves lower parasitic losses than any previously known high pressure fuel injection system. However, to obtain independent control over injection pressure and timing, the timing arrangement of the present invention is utilized in conjunction with an HPI or CELECT type fuel injector in which a hydraulic link is formed between plungers of a multi-plunger arrangement. This arrangement allows the injection pressure to be maintained constant over a wide range of engine speeds without interfering with engine timing.

In either case, a preferred way to rotate the eccentric shaft involves the use of a spool valve and a pair of on-off control valves which drain fluid from either side of the spool valve to rotate the eccentric shaft. An encoder is used to correctly position the shaft, the control valves being turned on and off until the shaft is determined to have reached the required angular position as determined by monitoring of the encoder.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIGS. 13 & 14 show embodiments of the timing arrangement in which timing adjustment is obtained with a rolling motion instead of a sliding motion.

DETAILED DESCRIPTION OF THE PREFERRED EMBODIMENTS

Figure 1:
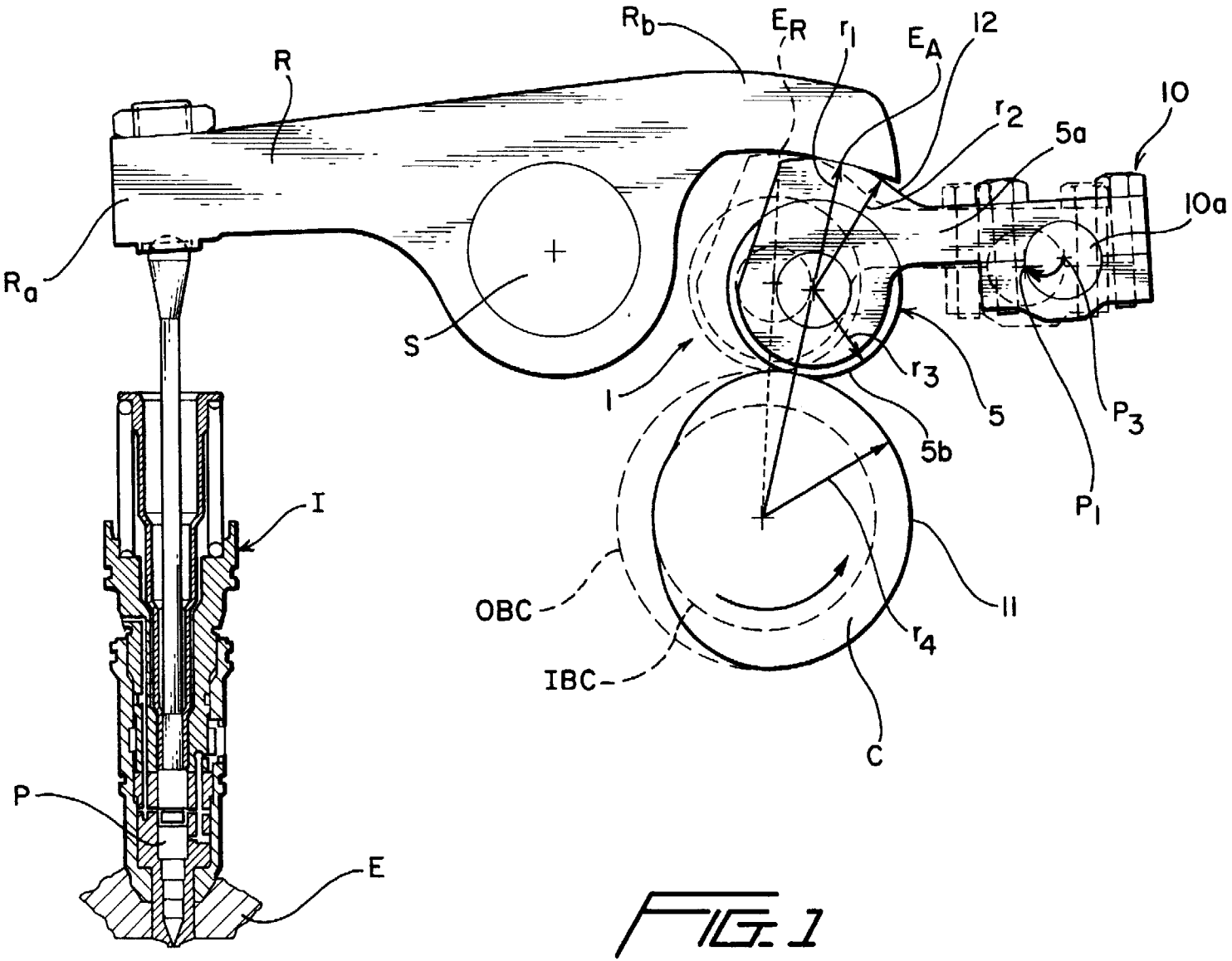
FIG. 1 Shows an embodiment of the invention in which the inventive eccentric shaft timing arrangement is used with a simple open nozzle type unit fuel injector.

FIG. 1 shows a first embodiment of a control arrangement 1 for unit fuel injectors in accordance with the present invention which permits adjustment of injection timing in a manner maintaining constant mechanical crush. The unit fuel injector I with which the control arrangement 1 is used of known design, the construction thereof, itself, apart from its use in the overall combination, forms no part of the present invention and other known injectors can be used instead, this fact being demonstrated by the showing of a simple open nozzle type fuel injector in FIG. 1 and a closed nozzle type fuel injector in FIG. 2. Likewise, as is known, fuel is injected by the injector I into a cylinder of an internal combustion engine E by the action of a first arm $R_a$ of rocker lever R on a reciprocatory plunger P of injector I, the rocker lever R being mounted to pivot on a rocker shaft S under the action of an injector cam C on a second arm $R_b$ of the rocker lever R.

Where this embodiment departs from the prior art is in the manner in which the onset of injection is adjusted, e.g., retarded or advanced timing is achieved. In particular, the control arrangement 1 comprises a cam follower 5 and a cam follower adjustment arrangement 10. Cam follower 5 is formed of a roller 5*b* that is freely rotatably carried on the free end of a pivot lever 5*a* which is, in turn, freely rotatably carried on an eccentrically mounted shaft 10*a* of the cam follower adjustment arrangement 10, so that rotation of eccentric shaft 10*a* causes the pivot axis of pivot lever 5*a* to shift as reflected by the solid line and broken line positions of cam follower 5 shown in FIG. 1, while in FIG. 2 points $P_1$, $P_2$, and $P_3$ represent the pivot axis of pivot lever 5*b* at positions corresponding to a 5° timing retard, mid-timing and a 5° timing advance, the roller 5*b* being shown in its mid-timing position and points $P_4$ and $P_5$ being the locations of the roller rotational axis at a 5° timing retard and a 5° timing advance position, respectively.

Cam C has a cam surface 11 upon which the roller 5*b* of the cam follower 5 runs. This cam surface has an injection lobe defined by an outer base circle OBC of radius $r_4$ and a retraction/compression lobe which runs from the outer base circle OBC to an inner base circle IBC and back. When the pivot lever 5*a* is shifted, the point at which the peripheral, follower surface of roller 5*b* rides on cam surface 11 is shifted as is the point at which an adjusting surface 12 of pivot lever 5*a* engages the second arm $R_b$ of the rocker lever R, positions $E_R$ and $E_A$ occurring when the roller 5*b* is on the outer base circle OBC for the retard and advance settings, respectively, of cam follower 5, the relationship between the rocker arm $R_b$, cam C and follower 5 when positions $E_R$ and $E_A$ are achieved being shown in an enlarged scale in FIGS. 3 and 4, respectively. Likewise, the point at which an adjusting surface 12 of pivot lever 5*a* engages the second arm $R_b$ of rocker lever R changes as the cam C rotates, engagement position $E_1$ in FIG. 2 occurring when the roller 5*b* is on the outer base circle OBC, and points $E_2$ and $E_3$ engaging when the roller 5*b* is at the inner base circle IBC for the mid-timing setting of cam follower 5 shown.

Since the injection plunger P bottoms out in the metering and injection chamber formed in the body of fuel injector I at the end of its downward stroke in the mid-timing position, i.e., when the cam follow reaches the portion of the cam surface 11 lying on the outer base circle OBC, if a conventional link having spherically rounded ends acts between the cam follower and the rocker lever, as in Straubel et al. patent mentioned above in the Background portion, the shifting of the cam follower by the eccentric shaft to effect retarding or advancing of injection timing will change the height of the rocker lever, and therefore the height of the injection plunger, resulting in either imprecise injection or excessive mechanical "crush" at the downward end the stroke of plunger P.

Figure 2:
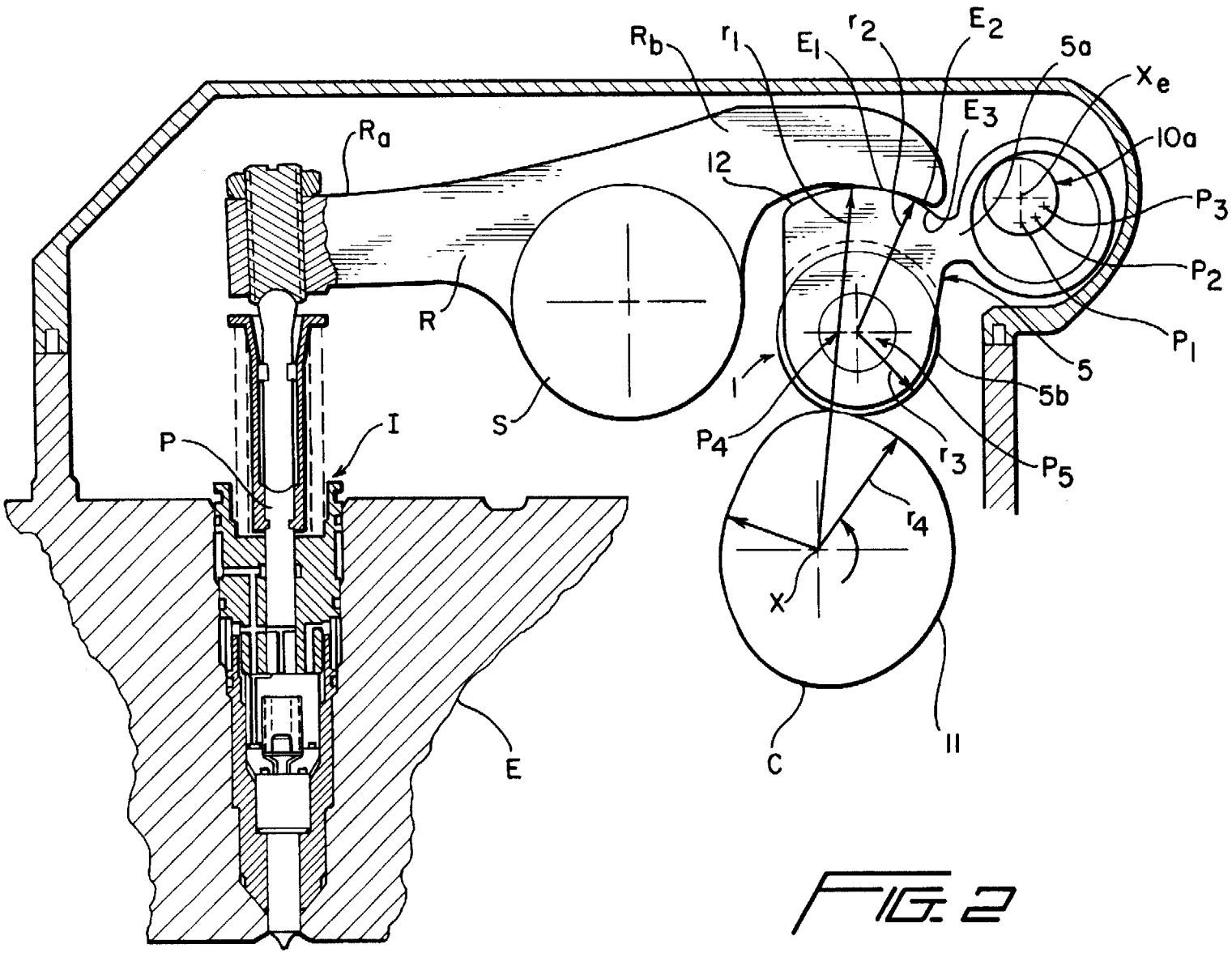
FIG. 2 shows the FIG. 1 embodiment used with a closed nozzle type unit fuel injector.

Thus, in accordance with the present invention, location of the center of the eccentric shaft $X_e$ and the geometry of the follower 5 and the actuating surface 14 of rocker arm $R_a$ are dimensioned relative to each other and relative to the geometry of the cam surface 11 as a means for insuring that the vertical height of the arms $R_a$, $R_b$ of the rocker lever R, when the point of engagement of the surface of follower roller 5b on the cam surface 11 is at the outer base circle OBC, remains constant even though the position of the pivot axis of the cam follower is displaced from the FIG. 2 mid-timing position toward either of position $P_4$ or $P_5$ by rotation of the eccentric shaft 10a.

This is result is achieved, firs fly, by selecting the radius of the outer base circle OBC and the radius of the follower roller 5b and providing the adjusting surface 12 of the cam follower 1 and adjusting surface 14 of the rocker arm $R_a$ with a contour that, for each of point of engagement between actuating surface 14 of the second rocker arm $R_b$ and the adjusting surface 12 occurring at least while the cam follower 1 is on the outer base circle OBC, a radius of curvature $r_1$ of actuating surface 14 of second rocker arm $R_b$ arm, measured from an axis of rotation X of the timing cam C, is equal to the sum of a radius of curvature $r_2$ of adjusting surface 12, measured from the axis of rotation of follower roller 5b, plus a radius of curvature $r_3$ of the follower roller 5b, measured from its axis of rotation to its periphery, plus a radius of curvature $r_4$ of the timing cam C, measured from its axis of rotation X to the portion of its cam surface 11 that lies on the outer base circle OBC have values which cause the relationship $r_1=r_2+r_3+r_4$ to remain constant for all values of the radii $r_1$, $r_2$, $r_3$, and $r_4$.

Figure 3:
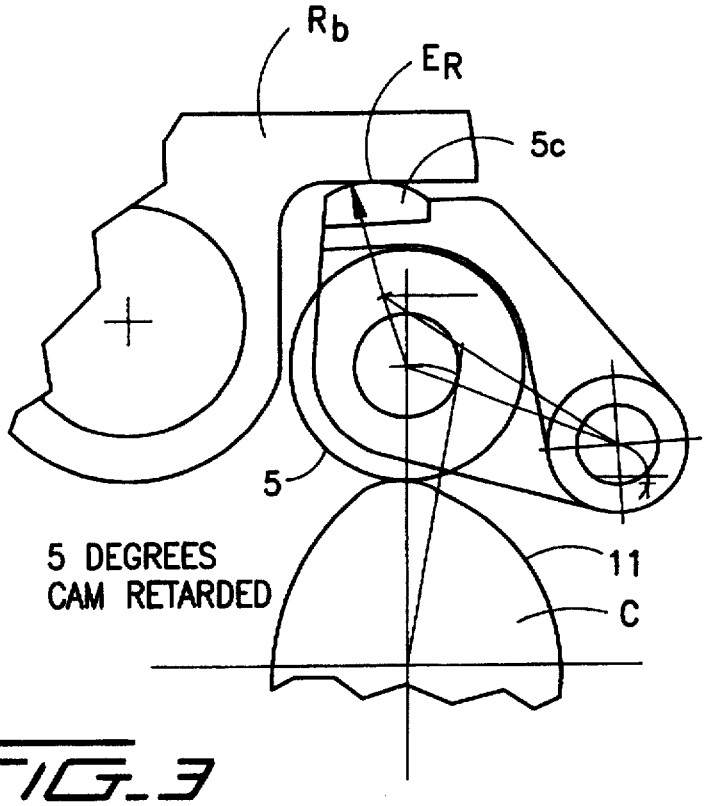
FIGS. 3 & 4 show a modified timing arrangement in positions for obtaining retarded and advanced timing, respectively.
Figure 4:
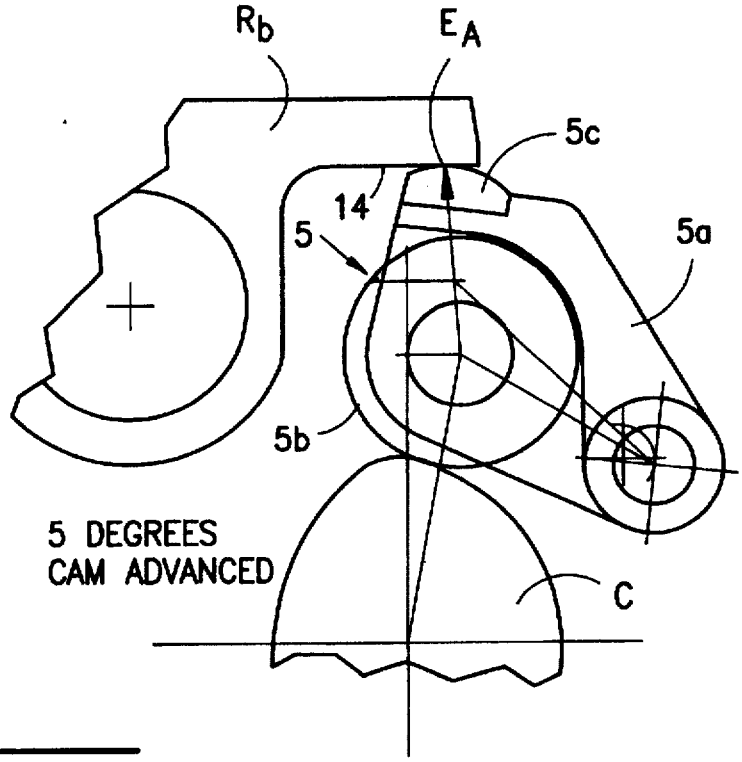
Figure 5:
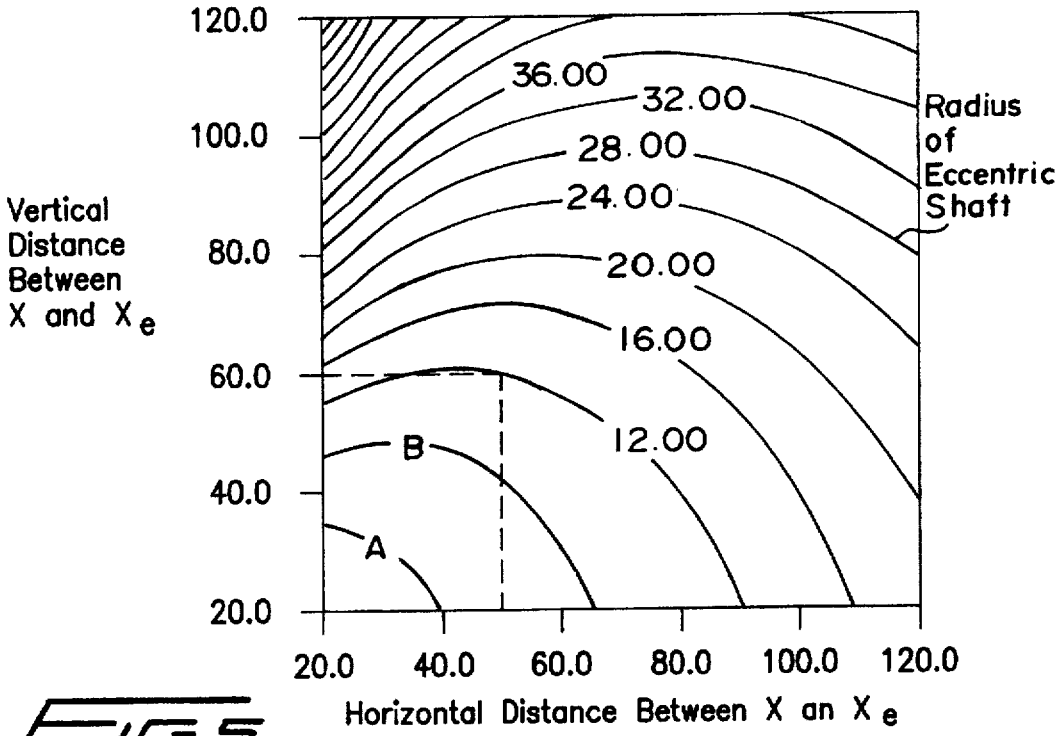
FIG. 5 is a plot depicting eccentric shaft radii necessary to maintain constant mechanical crush as a function of shaft location with the modified timing arrangement of FIGS. 3 & 4.

As should be apparent, numerous geometries will fit the above requirements, and for each of these geometries, numerous locations can be selected for the center of the eccentric shaft $X_e$. Furthermore, the vertical height of the center of the eccentric shaft $X_e$ is immaterial. However, if a rocker arm $R_b$ is to be used which has a flat actuating surface 14, as is shown in FIGS. 3 & 4, then the vertical height and the radius of the eccentric shaft must compensate for this fact (i.e., that $r_1$ is infinite). To facilitate this selection, computer programs can be written, and FIG. 5 illustrates the output of one such program. In FIG. 5, the abscissa represents the horizontal distance between cam axis X and eccentric shaft axis $X_e$, and the ordinate represents the vertical distance between the cam axis X and the eccentric shaft axis $X_e$, each curve representing a specific eccentric shaft radius. For example, from this graph, it can be seen that, if the axis $X_e$ of the eccentric shaft is to be positioned 50 mm above and to the right of cam axis X, eccentric shaft 10a should have a 12 mm radius to obtain the same effect as contouring actuating surface 14 with a radius $r_1$ in accordance with the above relationship and as shown in FIGS. 1 or 2.

Figure 6:
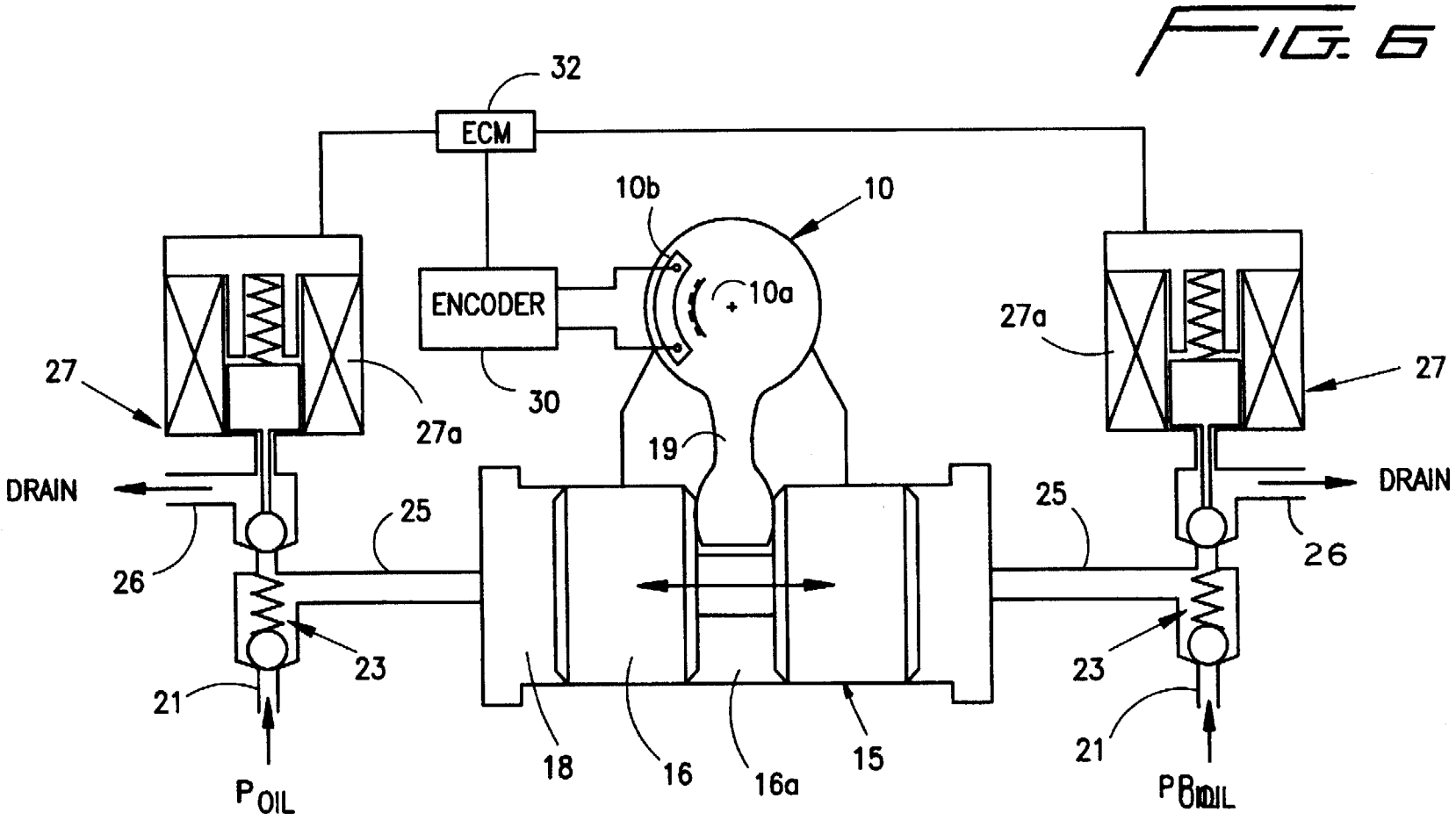
FIG. 6 is a schematic depiction of an actuator for rotation of the eccentric shaft of the timing arrangement.

Rotation of the eccentric shaft 10a can be achieved numerous ways, one such adjustment arrangement for rotating the eccentric shaft 10a relative to the cam follower 5 being shown in FIG. 6. In particular, the follower adjustment arrangement 10 shown comprises a spool valve 15 having a valve piston 16 disposed so as to be slidable within a valve chamber 18 and valve piston 16 is connected to the eccentric shaft 10a via a crank arm 19 that is attached to the eccentric shaft 10a, the free end of crank arm 19 being received in an annular groove 16a of the valve piston 16. Oil under pressure is supplied to valve chamber 18 at each of opposite ends of spool valve 16 via supply line 21, check valve 23 and valve connection line 25. Each valve connection line 25 is also connected to a drain line via a control valve 27 which controls draining of fluid from the valve chamber 18 at a respective end of the spool valve piston 16.

When one control valve 27 is open and the other is closed, the pressure drops at the check valve connection to the supply line 21 by the open control valve 27 and fluid to drain from that side of the spool valve 15. At the same time, the check valve 23 at the closed control valve is open, enabling fluid to flow to chamber 18 at that side. As a result, the spool valve piston 16 moves toward the side at which the valve connection line 25 is in communication with the drain line 26 via the open control valve 27. When both control valves 27 are closed, the piston 16 becomes locked in place. However, no particular significance is attached to the manner in which movement of spool valve piston 16 is obtained and other techniques, such as that shown in Japanese Patent Publication 56-92329, will be known to those skilled in the art and any such means for controlling movement of piston 16 is considered a substitutable equivalent for purposes of this invention.

Additionally, an angular position detecting encoder 30 is connected to the eccentric shaft 10a and the support 10b within which it rotates for determining the angular position of the eccentric shaft 10a by its position relative to its support 10b. The output of the encoder 30 is supplied to an electronic controller 32, such as the electronic control module (ECM) that is conventionally provided for controlling the operation of electronic fuel injections systems, including injection timing, on the basis of engine operating conditions. When the ECM determines that engine timing should be advanced or retarded, a signal is sent to the solenoids 27a of the control valves 27 to open and close communication between the drain line 26 and the valve connection line 25 to shift the spool valve plunger 16 until the eccentric shaft 10a is determined to be in a required angular position based upon the angular position of the eccentric shaft 10a detected by the position detecting encoder 30, which is monitored by the electronic controller 32. While such an arrangement for detecting and monitoring the angular position of the eccentric shaft 10a is preferred, the eccentric shaft could be displaced and its position monitored as shown and described relative to the FIG. 2 embodiment of the above-mentioned Straubel et al. patent.

The control arrangement described so far used in combination with a simple fuel injector of the type with an injector body having a metering and injection chamber from which fuel is injected by reciprocatory injection plunger P being displaced inwardly by the action of the rocker lever R in a purely mechanical manner minimizes parasitic losses and the fuel heating problems associated therewith. However, as noted initially, to meet future emissions and performance requirements, it now appears that it will be necessary to be able to control injection pressure independently of injection timing, thereby enabling, for example, the injection pressure to be maintained constant despite a change in timing, and such cannot be achieved with a fuel injector having a purely mechanical driven injection plunger.

Thus, a further embodiment will now be described by which the control arrangement of the present invention is combined with a fuel injector of the initially-mentioned HPI and CELECT multi-plunger unit injector type (an HPI injector being shown in FIG. 7) to achieve this result. In injectors of this type, the reciprocatory injection plunger P is one plunger of a multi-plunger assembly having an upper plunger U and a plunger T (which in normal use of such an injector is a timing plunger, but which serves for pressure control in accordance with this invention), the rocker lever R acting on the injection plunger P for the injection of fuel from the metering and injection chamber via the plungers U and T of the plunger assembly and a variable height hydraulic link being formed by a variable volume chamber between the plungers U and T (this chamber being fully collapsed at the end of injection as shown). Further details of the nature and operation of such injectors can be obtained by reference to one or more of the patents cited as examples of this type of injector in the Background portion of this application since the construction thereof, itself, apart from its use in the overall combination, forms no part of the present invention.

Figure 8:
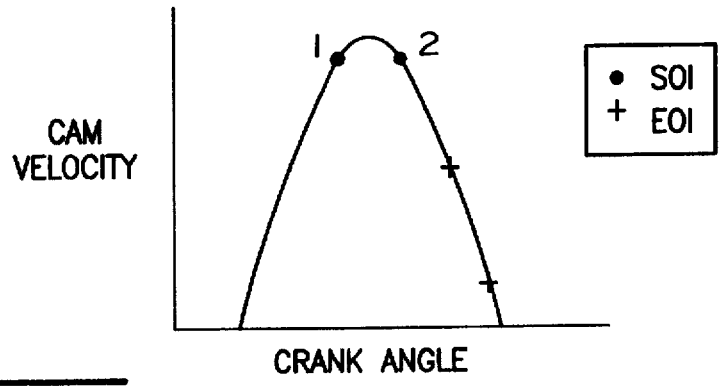
FIGS. 8–10 are graphs depicting the relationship between crank angle and cam velocity for a prior art injector, the FIG. 1 embodiment and the FIG. 6 embodiment, respectively.
Figure 9:
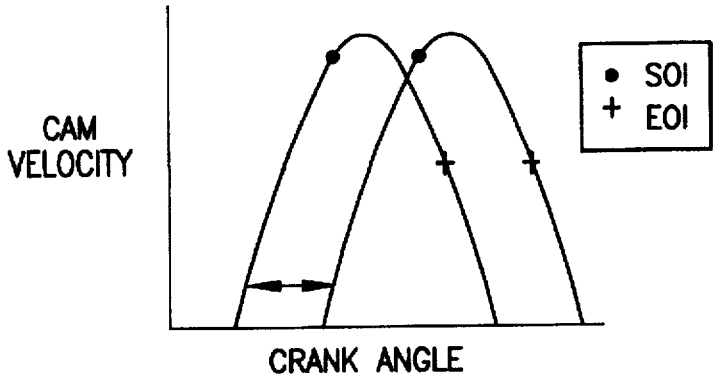

FIG. 8 shows how cam velocity, and therefore injection pressure which related thereto, is affected by a change in injection timing for the mentioned known HPI, CELECT and similar multi-plunger type unit fuel injectors. As can be seen in FIG. 8, the start of injection (SOI) occurs at the same velocity at points 1 and 2, yet, at the end of injection (EOI), a substantial difference in velocity (pressure) exists between the advanced (points 1) and retarded (points 2) timing cases, the injection event (SOI to EOI) occurring at a higher camshaft velocity for advanced timing than at retarded timing. In FIG. 9, the same two timing cases are depicted for the first embodiment of the invention in which an injector having a purely mechanically driven injection plunger is used. As represented therein SOI and EOI each occur at essentially the same camshaft velocity (pressure) despite a change in injection timing.

Figure 7:
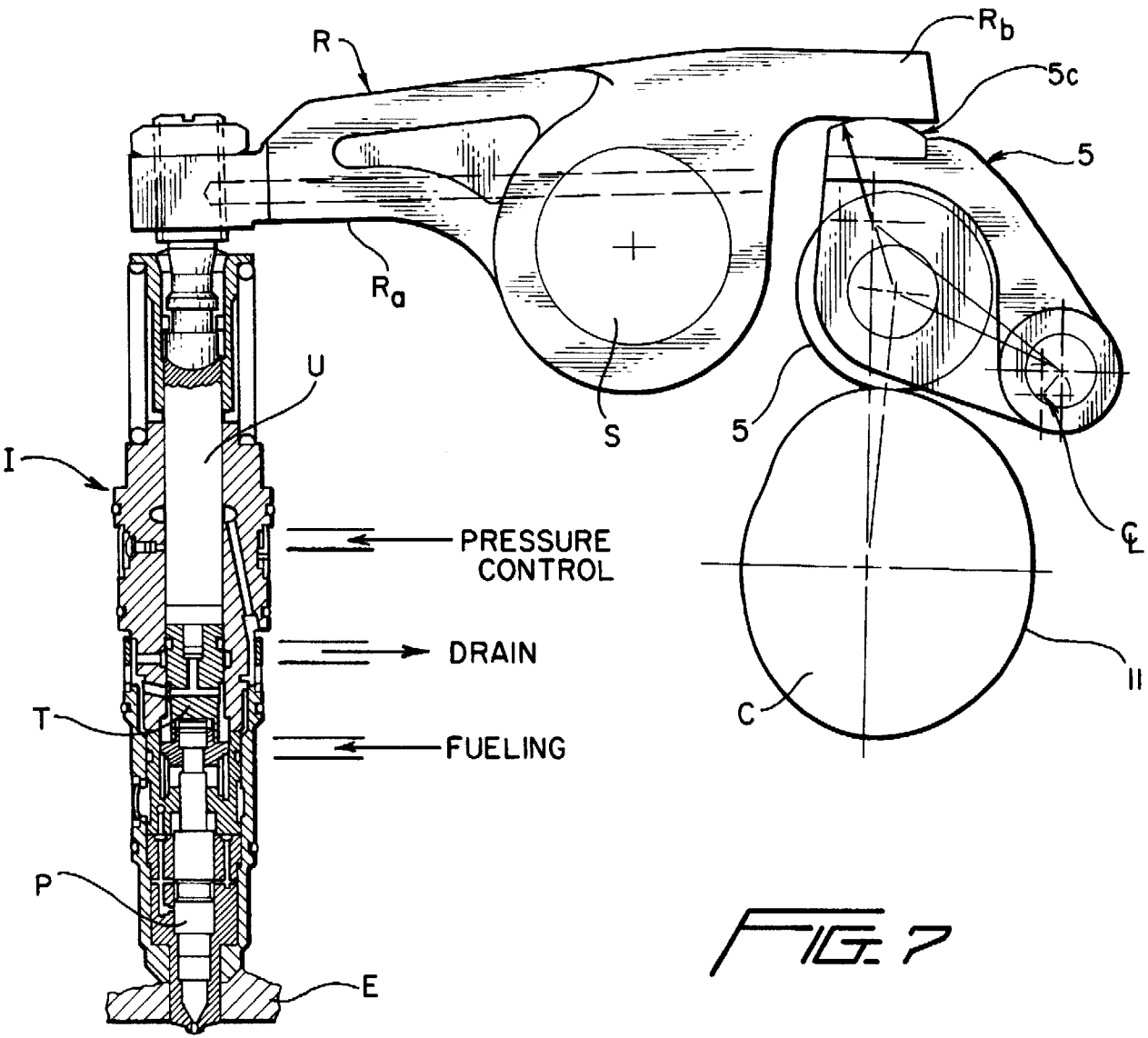
FIG. 7 shows an embodiment of the invention in which the inventive eccentric shaft timing arrangement is used with a hydraulic link type multi-plunger unit fuel injector.
Figure 10:
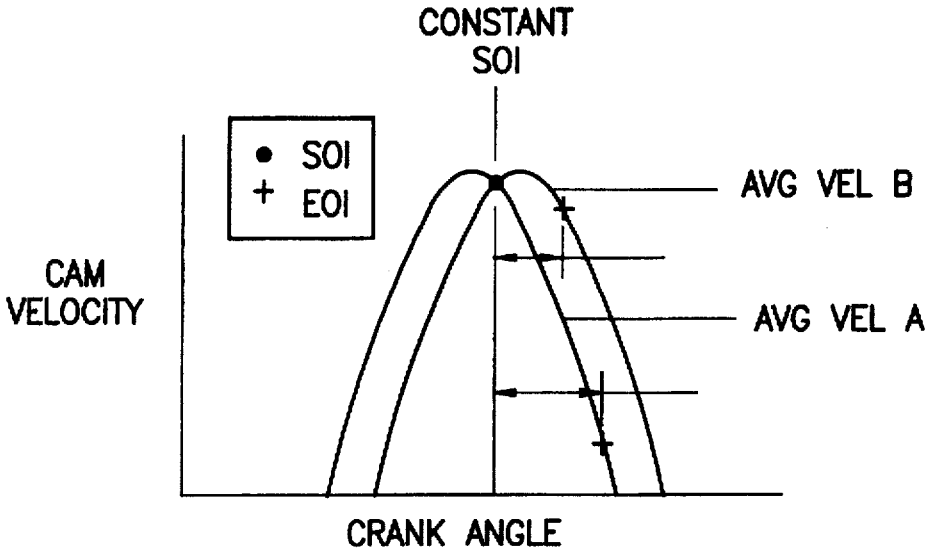
Figure 11:
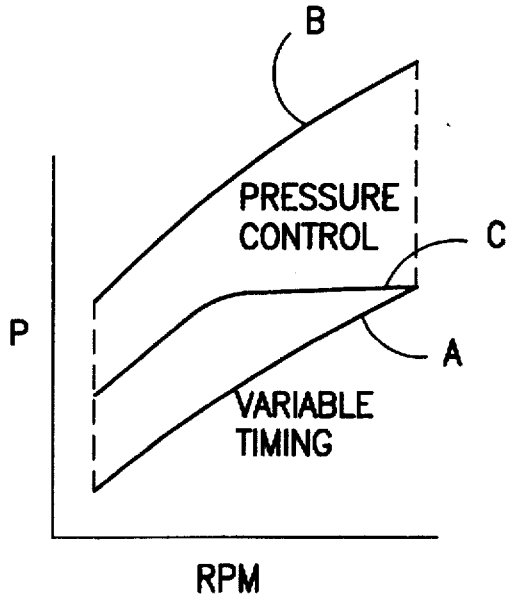
FIG. 11 is a graph showing the relationship between engine speed and injection pressure achievable with the present invention.

FIGS. 10 and 11 depict how, by combining the control arrangement 1 of the FIG. 1 embodiment with a known HPI, CELECT or similar multi-plunger type unit fuel injector in the manner of the FIG. 7 embodiment, introduces another degree of freedom which allows variable pressure to be achieved in addition to variable timing. That is, as shown in FIG. 10, the start of injection SOI commences at a constant cam velocity (as in the cases represented in FIGS. 8 & 9) irrespective of any advance or retarding of engine timing. From this point, the control arrangement 1 and the timing chamber (variable hydraulic link) of the multi-plunger injector can be used separately and/or together to the control the velocity of the injection plunger P and therewith the pressure of injection so as to achieve a low average velocity/pressure A or a high average velocity/pressure B for any given engine timing selected by the ECM. Thus, a pressure-engine speed curve can be obtained along any desired curve between curves A and B in FIG. 11 (which represents a peak pressure, full load curve at a given engine timing) irrespective of whether injection timing is varied or not, a preferred pressure curve in the obtainable range being represented by curve C.

Figure 12:
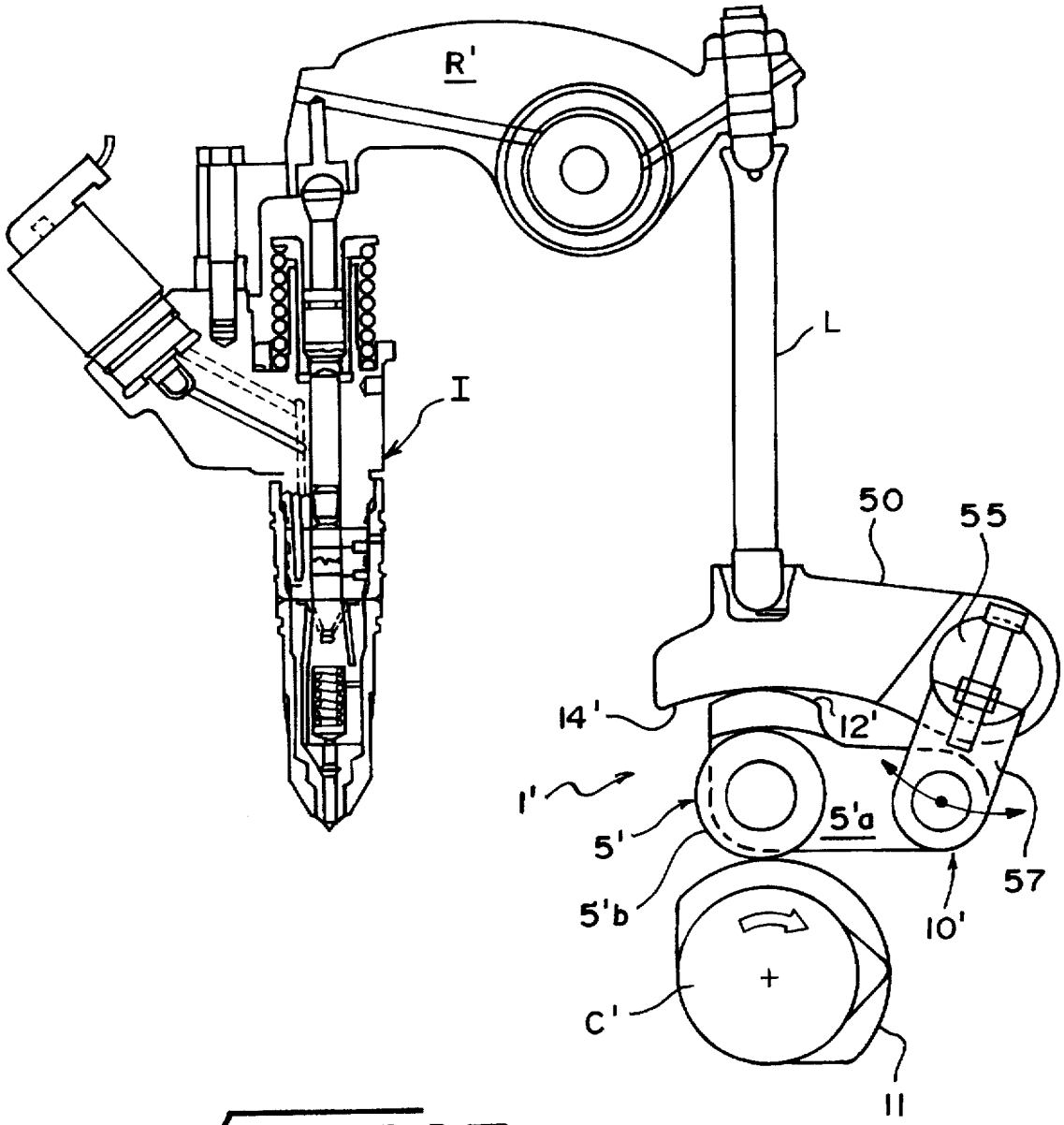
FIG. 12 schematically shows the timing arrangement of FIGS. 12 & 13 used with another type of multiplunger unit fuel injector.

The arrangements described so far, e.g., as shown in FIGS. 1 and 7, have been typical overhead cam type applications. However, the present invention is applicable to engines in which the cam is not located at the top of the engine. FIG. 12 shows an arrangement which is applicable to engines where the cam is located at a lower portion of the engine, the cam follower 5' of the control arrangement 1' acting on the rocker arm R' in response to the rotation of cam C' via the intermediary of a link rod L.

In this case, the actuating surface 14 upon which the cam follower 5' acts is not on the rocker arm R', itself, but rather is on a pivotable actuating arm 50 that is journaled on an adjusting shaft 55. A crank arm 57 mounted to the adjusting shaft 55 so that it is swung in the directions of the double arrow in FIG. 12 with rotation of the adjusting shaft 55. The pivot lever **5'*a* of cam follower 5 is formed as a swing arm, one end of which is pivotally mounted to the crank arm 57 and the opposite end of which pivotally carries the cam follower roller 5'*b* and the adjusting surface 12'. Thus, rotation of adjusting shaft 55 swings crank arm 57 displacing the cam follower 5' crosswise relative to the axis of rotation of cam C'. During this displacement, for example, between the positions shown in FIGS. 13 and 14, unlike the case for the above described embodiments in which the adjusting surface 12 is caused to slide along the actuating surface 14, in this embodiment, a rolling engagement is produced between the adjusting surface 12' of the cam follower 5' and the actuating surface 14' of the actuating arm 50. This rolling engagement is provided by interengaged very small teeth or serrations at a lateral side of the adjusting surface 12 and actuating surface 14, these teeth being greatly exaggerated in size for illustration purposes in FIG. 14 (such teeth/serrations existing in FIG. 13** but not being visible when shown to scale).

Apart from the changes described, the same principles described for the first embodiments apply here as well. For example, the principles governing the relationship between the radii $r_1$, $r_2$, $r_3$, and $r_4$ described above applies. Likewise, while the embodiment of Figs. 13 and 14 has not been shown with an overhead cam type arrangement, the advantages of obtaining a rolling interaction between the adjusting and actuating surfaces can be obtain in that context as well. In such a case, it is merely necessary to substitute the adjusting shaft 55, crank arm 57 and follower assembly 5' for the follower assembly 5 and eccentric shaft of the earlier embodiments, the link rod L and the actuating arm 50 being eliminated.

While various embodiments in accordance with the present invention have been shown and described, it is understood that the invention is not limited thereto, and is susceptible to numerous changes and modifications as known to those skilled in the art. For example, the cam follower 5 can take various form, three different types of follower levers **5*a* being shown in FIGS. 1, 2 and 3, and FIGS. 3 & 4 showing the FIG. 7 lever being used in connection with the FIG. 1 injector embodiment. FIGS. 3, 4 and 7 also show how the adjusting surface 12 of the follower 5 can be formed of a separate, wear-resistant ceramic pad 5*c* that is attached to the lever 5*a* instead of being formed directly thereon. Clearly, the follower levers 5*a* of FIGS. 1 and 2 could be provided with such a wear pad 5*c* without affecting any other aspect thereof. Likewise, while an eccentric shaft has been described as the preferred means for moving the follower lever 5*a*, other movement means can be used, and at least in the case of the embodiments shown FIG. 1 and 2, where the height of the eccentric shaft is not significant, virtually and means for horizontal displacement of the cam follower 5** could be used. Therefore, this invention is not limited to the details shown and described herein, and includes all such changes and modifications as are encompassed by the scope of the appended claims.

Industrial Application

The present invention will find a wide range of applicability in connection with fuel injection systems for internal combustion engines for vehicles and other uses due to the disclosed control arrangement being combinable with both open and closed type fuel injectors having either a purely mechanically driven injection plunger or an injection plunger that is part of a multi-plunger arrangement having a variable height hydraulic link formed by a variable chamber between two of the plungers of the multi-plunger arrangement.

We claim:

1. Control arrangement for unit fuel injectors having a reciprocatory injection plunger, comprising a rocker lever having a first arm for acting on an upper end of a reciprocatory injection plunger and a second arm which is acted upon by a rotary timing cam via a cam follower; wherein said timing cam has a cam surface, a portion of which lies on an outer base circle and a portion of which runs between an inner base circle and said outer base circle; wherein said cam follower has a follower surface which rides on said cam surface and an adjusting surface in engagement with an actuating surface for movement of the second arm of the rocker lever, said cam follower being mounted for pivotable movement about a pivot axis; wherein means are provided for displacing the pivot axis of the cam follower crosswise relative to an axis of rotation of the cam so as to shift a point of engagement of said follower surface on the cam surface and a point of engagement of said adjusting surface on said actuating surface; and wherein the geometry of the follower and of the second arm of the rocker lever are dimensioned relative to each other and relative to the geometry of the cam surface as a means for insuring that the vertical height of the arms of the rocker lever when the point of engagement of said follower surface on the cam surface is at the outer base circle remains constant even though the position of the pivot axis of the cam follower is displaced by the means for displacing.

2. Control arrangement for unit fuel injectors according to claim 1, wherein the follower surface is defined by the periphery of a roller mounted on a lever arm of said cam follower; and wherein, for each of said points of engagement at the outer base circle, a radius $r_1$ of the actuating surface for movement of the second arm of the rocker lever measured from the axis of rotation of said timing cam to the point of engagement of said actuating surface on said adjusting surface of the cam follower is equal to the sum of a radius $r_2$ measured from an axis of rotation of said roller to said point of engagement of said actuating surface on said adjusting surface of the cam follower plus a radius $r_3$ measured from the axis of rotation of the roller to the periphery thereof plus a radius $r_4$ measured from the axis of rotation of the timing cam to the portion of the cam surface on said outer base circle have values which cause the relationship $r_1=r_2+r_3+r_4$ to remain constant for all positions of the pivot axis of the cam follower.

3. Control arrangement for unit fuel injectors according to claim 1, wherein said actuating surface is on the second arm of the rocker lever; and wherein the means for displacing comprises an eccentric shaft that is rotatable relative to the cam follower and adjustment means for rotating the eccentric shaft.

4. Control arrangement for unit fuel injectors according to claim 1, wherein said adjustment means comprises a spool valve disposed in a valve chamber and connected to said eccentric shaft, valve means for controlling fluid flow to said valve chamber for displacing of said spool valve, position detecting means for determining the position of said eccentric shaft, and control means for operating said control valve means to shift said spool valve until the shaft is detected to be in a required angular position by said position detecting means.

5. Control arrangement for unit fuel injectors according to claim 4, wherein said position detecting means is an angular position encoder, the valve means being turned opened and closed by said control means until the shaft is determined to have reached the required angular position as determined by monitoring of the encoder.

6. Unit fuel injection system comprising a unit fuel injector having a reciprocatory injection plunger, a rocker lever having a first arm for acting on an upper end of the reciprocatory injection plunger and a second arm which is acted upon by a rotary timing cam via a cam follower; wherein said timing cam has a cam surface running between an inner base circle and an outer base circle; wherein said cam follower has a follower surface which rides on said cam surface and an adjusting surface in engagement with an actuating surface for movement of the second arm of the rocker lever, said cam follower being mounted for pivotable movement about a pivot axis; wherein means are provided for displacing the pivot axis of the cam follower crosswise relative to an axis of rotation of the cam so as to shift a point of engagement of said follower surface on the cam surface and a point of engagement of said second arm on said actuating surface; and wherein the geometry of the follower and of the adjusting surface of the rocker lever are dimensioned relative to each other and relative to the geometry of the cam surface as a means for insuring that the vertical height of the arms of the rocker lever when the point of engagement of said follower surface on the cam surface is at the outer base circle remains constant even though the position of the pivot axis of the cam follower is displaced by the means for displacing.

7. Unit fuel injection system according to claim 6, wherein the follower surface is defined by the periphery of a roller mounted on a lever arm of said cam follower; and wherein, for each of said points of engagement at the outer base circle, a radius $r_1$ of the actuating surface for movement of the second arm of the rocker lever measured from the axis of rotation of said timing cam to the point of engagement of said actuating surface on said adjusting surface of the cam follower is equal to the sum of a radius $r_2$ measured from an axis of rotation of said roller to said point of engagement of said actuating surface on said adjusting surface of the cam follower plus a radius $r_3$ measured from the axis of rotation of the roller to the periphery thereof plus a radius $r_4$ measured from the axis of rotation of the timing cam to the portion of the cam surface on said outer base circle have values which cause the relationship $r_1=r_2+r_3+r_4$ to remain constant for all positions of the pivot axis of the cam follower.

8. Unit fuel injection system according to claim 5, wherein said actuating surface is on the second arm of the rocker lever; and wherein the means for displacing comprises an eccentric shaft that is rotatable relative to the cam follower and adjustment means for rotating the eccentric shaft.

9. Unit fuel injection system according to claim 8, wherein said adjustment means comprises a spool valve disposed in a valve chamber and connected to said eccentric shaft, valve means for controlling fluid flow to said valve chamber for displacing of said spool valve, position detecting means for determining the position of said eccentric shaft, and control means for operating said control valve means to shift said spool valve until the shaft is detected to be in a required angular position by said position detecting means.

10. Unit fuel injection system according to claim 9, wherein said wherein said position detecting means is an angular position encoder, the valve means being turned opened and closed by said control means until the shaft is determined to have reached the required angular position as determined by monitoring of the encoder.

11. Unit fuel injection system according to claim 6, wherein said fuel injector comprises an injector body having a metering and injection chamber therein; wherein said rocker lever acts on said reciprocatory injection plunger for the injection of fuel from said metering and injection chamber in a purely mechanical manner; and wherein said adjustment means constitutes a timing control means for controlling of the timing of said injection of fuel from said metering and injection chamber.

12. Unit fuel injection system according to claim 6, wherein said fuel injector comprises an injector body having a metering and injection chamber therein; wherein said reciprocatory injection plunger is one plunger of a multi-plunger assembly; wherein said rocker lever acts on said reciprocatory injection plunger for the injection of fuel from said metering and injection chamber via said plunger assembly and a variable volume hydraulic link formed between plungers of said multi-plunger assembly; and wherein said adjustment means together with said hydraulic link constitute an injection control means for enabling the timing and pressure of said injection of fuel from said metering and injection chamber to be adjusted independently of each other.

13. Control arrangement for unit fuel injectors according to claim 1, wherein actuating surface is on said second arm of the rocker arm.

14. Control arrangement for unit fuel injectors according to claim 1, wherein said actuating surface is on a pivotable actuating arm which acts on the second arm of the rocker arm via a force-transmitting link rod.

15. Control arrangement for unit fuel injectors according to claim 14, wherein said means for displacing comprises a crank arm pivotally mounted to an adjusting shaft upon which said actuating arm is journalled, and a swing arm, one end of which is mounted to said crank arm and a second end of which pivotally carries said cam follower; and wherein said means for displacing produces a rolling engagement between the adjusting surface of the cam follower and the actuating surface of the actuating arm.

16. Unit fuel injection system according to claim 6, wherein actuating surface is on said second arm of the rocker arm.

17. Unit fuel injection system according to claim 6, wherein said actuating surface is on a pivotable actuating arm which acts on the second arm of the rocker arm via a force-transmitting link rod.

18. Unit fuel injection system according to claim 17, wherein said means for displacing comprises a crank arm mounted to said actuating arm and a swing arm, one end of which is pivotally mounted to said crank arm and a second end of which pivotally carries said cam follower; and wherein said means for displacing produces a rolling engagement between the adjusting surface of the cam follower and the actuating surface of the actuating arm.

* * * * *